US006732462B1

(12) United States Patent
Kramer

(10) Patent No.: US 6,732,462 B1
(45) Date of Patent: May 11, 2004

(54) DISPLAY CASE SYSTEM

(76) Inventor: Eric J. Kramer, 79 E. County Rd. 'B', St. Paul, MN (US) 55117

( * ) Notice: Subject to any disclaimer, the term of this patent is extended or adjusted under 35 U.S.C. 154(b) by 0 days.

(21) Appl. No.: 10/400,513

(22) Filed: Mar. 26, 2003

(51) Int. Cl.[7] ..... A47G 1/06
(52) U.S. Cl. ..... 40/800; 312/114
(58) Field of Search ..... 40/800, 743, 600; 312/114, 140, 138.1, 234, 245, 293.3

(56) References Cited

U.S. PATENT DOCUMENTS

| | | | | | |
|---|---|---|---|---|---|
| 1,313,498 | A | * | 8/1919 | Nason | 312/114 |
| 3,067,822 | A | * | 12/1962 | Hattenhauer | 312/242 |
| 3,333,358 | A | | 8/1967 | Green et al. | 40/160 |
| 3,503,147 | A | | 3/1970 | Herrin et al. | 40/124.1 |
| 3,715,823 | A | | 2/1973 | Brossard | 40/152 |
| 3,792,543 | A | * | 2/1974 | Powell | 40/800 |
| 4,244,303 | A | * | 1/1981 | Kurasik | 40/766 |
| 4,561,200 | A | | 12/1985 | Hehn | 40/156 |
| 4,763,428 | A | | 8/1988 | Fischer | 40/152 |
| 4,831,754 | A | * | 5/1989 | Tallent | 40/800 |
| 4,852,282 | A | * | 8/1989 | Selman | 40/600 |
| 5,118,171 | A | * | 6/1992 | Ortiz | 312/114 |
| 5,699,631 | A | | 12/1997 | Tyson | 40/621 |
| 5,743,038 | A | | 4/1998 | Soto | 40/743 |
| 5,985,379 | A | | 11/1999 | Longsdorf et al. | 428/13 |
| 5,985,413 | A | | 11/1999 | Boyle et al. | 428/174 |
| 5,987,790 | A | | 11/1999 | Sullivan | 40/1.5 |
| 6,254,527 | B1 | | 7/2001 | August | 600/27 |
| 6,263,598 | B1 | | 7/2001 | Sullivan | 40/1.5 |
| 6,315,375 | B1 | * | 11/2001 | Reeves et al. | 40/800 |

* cited by examiner

*Primary Examiner*—Gary Hoge

(57) ABSTRACT

A display case system for providing a display area that may be easily modified for providing a versatile collection of memorabilia. The display case system includes a rear plate having a front surface, a frame structure removably attachable to the rear plate, and a transparent enclosure positioned within the frame structure. The rear plate preferably includes a plurality of securing members that are catchably received within corresponding receiver apertures within the frame structure.

18 Claims, 6 Drawing Sheets

DISPLAY CASE SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to displays and more specifically it relates to a display case system for providing a display area that may be easily modified for providing a versatile collection of memorabilia.

It is extremely important for individuals suffering from mental illnesses such as dementia to have a constant recollection of important events, friends, family, personal items, words of special meaning and memorabilia. This is particularly true for residents of nursing homes where they are positioned within an unfamiliar setting without any "reminders" of their life. Recollection of past memories and experiences is important to a resident in order for them to continue feeling comfortable with their surrounding while having lost a portion of their memory. Hence, there is a need for a display case that allows for the easy creation and modification of a memorabilia collection that may be positioned upon a wall near a door or other well traveled location for an individual to view.

2. Description of the Related Art

Examples of patented devices which may be related to the present invention include U.S. Pat. No. 5,699,631 to Tyson; U.S. Pat. No. 3,715,823 to Brossard; U.S. Pat. No. 3,333,358 to Green et al.; U.S. Pat. No. 5,743,038 to Soto; U.S. Pat. No. 4,763,428 to Fischer; U.S. Pat. No. 3,503,147 to Herrin et al.; U.S. Pat. No. 4,561,200 to Hehn; U.S. Pat. No. 5,985,379 to Longsdorf et al.; U.S. Pat. No. 5,985,413 to Boyle et al.; U.S. Pat. No. 5,987,790 to Sullivan; U.S. Pat. No. 6,263,598 to Sullivan; and U.S. Pat. No. 6,254,527 to August.

While these devices may be suitable for the particular purpose to which they address, they are not as suitable for providing a display area that may be easily modified for providing a versatile collection of memorabilia. Conventional display cases are not designed for easy insertion and positioning of various types of memorabilia to allow for constant viewing by an individual suffering from a mental illness.

In these respects, the display case system according to the present invention substantially departs from the conventional concepts and designs of the prior art, and in so doing provides an apparatus primarily developed for the purpose of providing a display area that may be easily modified for providing a versatile collection of memorabilia.

BRIEF SUMMARY OF THE INVENTION

In view of the foregoing disadvantages inherent in the known types of display cases now present in the prior art, the present invention provides a new display case system construction wherein the same can be utilized for providing a display area that may be easily modified for providing a versatile collection of memorabilia.

The general purpose of the present invention, which will be described subsequently in greater detail, is to provide a new display case system that has many of the advantages of the display cases mentioned heretofore and many novel features that result in a new display case system which is not anticipated, rendered obvious, suggested, or even implied by any of the prior art display cases, either alone or in any combination thereof.

To attain this, the present invention generally comprises a rear plate having a front surface, a frame structure removably attachable to the rear plate, and a transparent enclosure positioned within the frame structure. The rear plate preferably includes a plurality of securing members that are catchably received within corresponding receiver apertures within the frame structure.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a display case system that will overcome the shortcomings of the prior art devices.

A second object is to provide a display case system for providing a display area that may be easily modified for providing a versatile collection of memorabilia.

Another object is to provide a display case system that provides a constant reminder to an individual regarding family, friends, personal items and words of special meaning.

An additional object is to provide a display case system that allows for easy insertion and removal of memorabilia.

A further object is to provide a display case system that assists individuals in remembering important events, people and animals in their lives.

Another object is to provide a display case system that provides a unique visual collection of an individual's life.

A further object is to provide a display case system that allows nursing home staff members to view important personal history about the patient.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
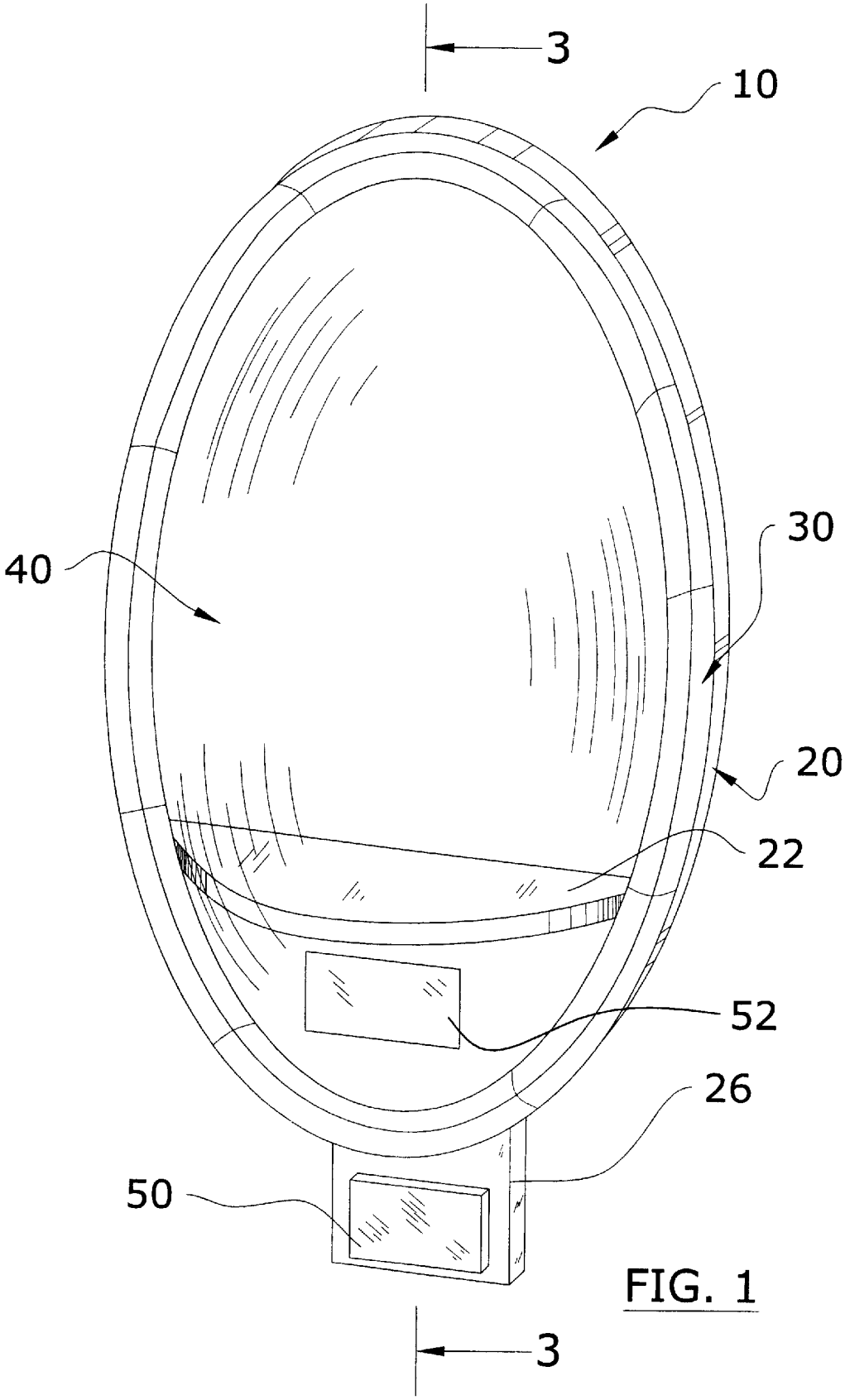
FIG. 1 is an upper perspective view of the present invention.

Turning now descriptively to the drawings, in which similar reference characters denote similar elements throughout the several views, FIGS. 1 through 5 illustrate a display case system 10, which comprises a rear plate 20 having a front surface 28, a frame structure 30 removably attachable to the rear plate 20, and a transparent enclosure 40 positioned within the frame structure 30. The rear plate 20 preferably includes a plurality of securing members 24 that are catchably received within corresponding receiver apertures 32 within the frame structure 30.

B. Rear Plate

The rear plate 20 has a front surface 28 and a rear surface. The rear plate 20 may have various shapes, sizes and structures. The rear plate 20 may be comprised of various materials such as metal. The rear plate 20 is attachable to a wall structure utilizing conventional fasteners and fastening structures.

The front surface 28 is comprised of a metallic layer for receiving magnetic display items 12. The front surface 28 may be comprised of various metallic structures such as a layer of metal or other layer of metal for receiving magnets. If the rear plate 20 is comprised of metal, then a metallic layer is not required to support the magnetic display items 12.

Figure 2:
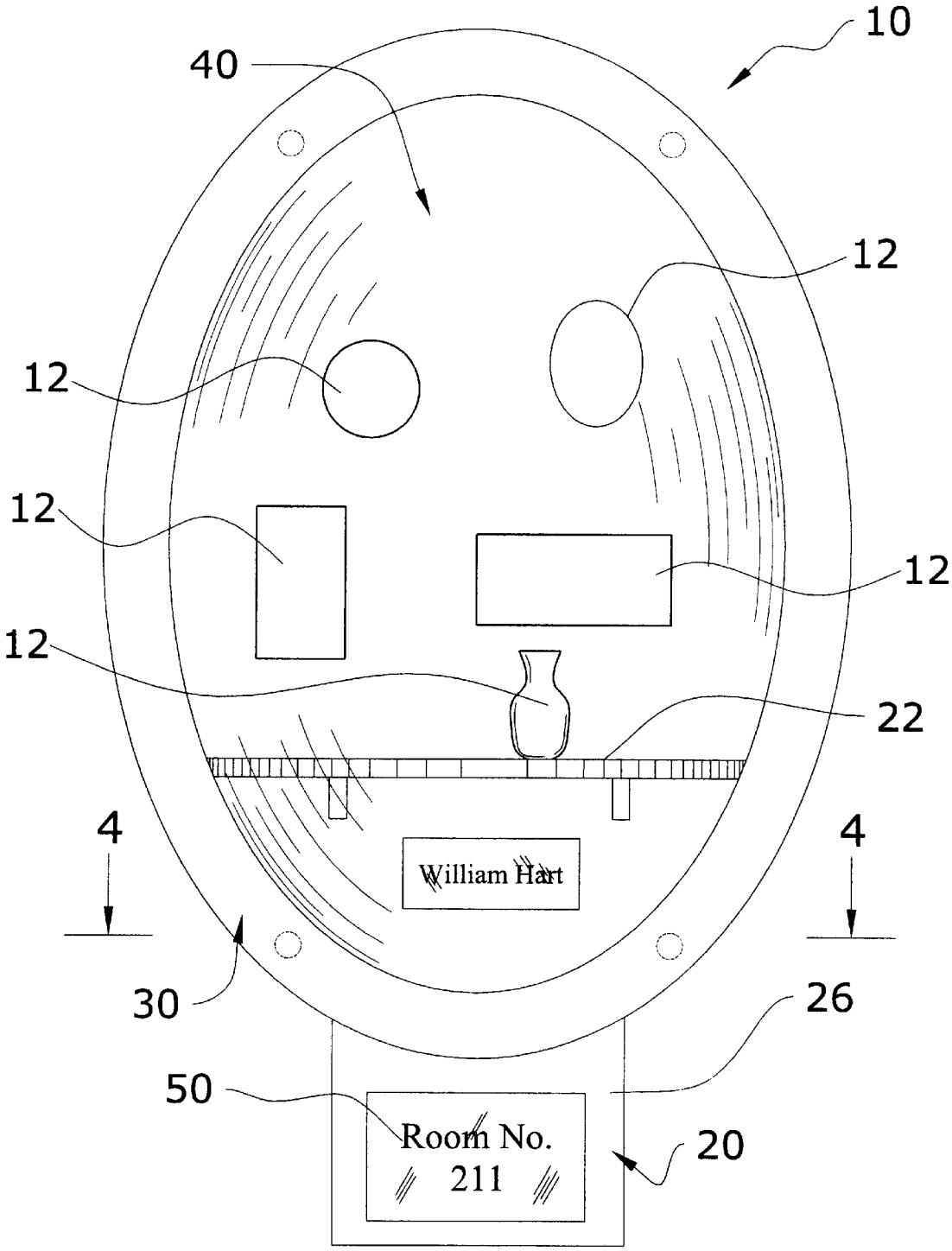
FIG. 2 is a front view of the present invention.

An extended portion 26 extends downwardly from a lower portion of the rear plate 20 as shown in FIGS. 1 and 2 of the drawings. A sign structure 50 is attached to the lower portion for indicating various types of information such as but not limited to a room number. An identification structure 52 is preferably attached to the front surface 28 of the rear plate 20 for indicating various types of information such as but not limited to a resident's name.

C. Support Shelf

Figure 4:
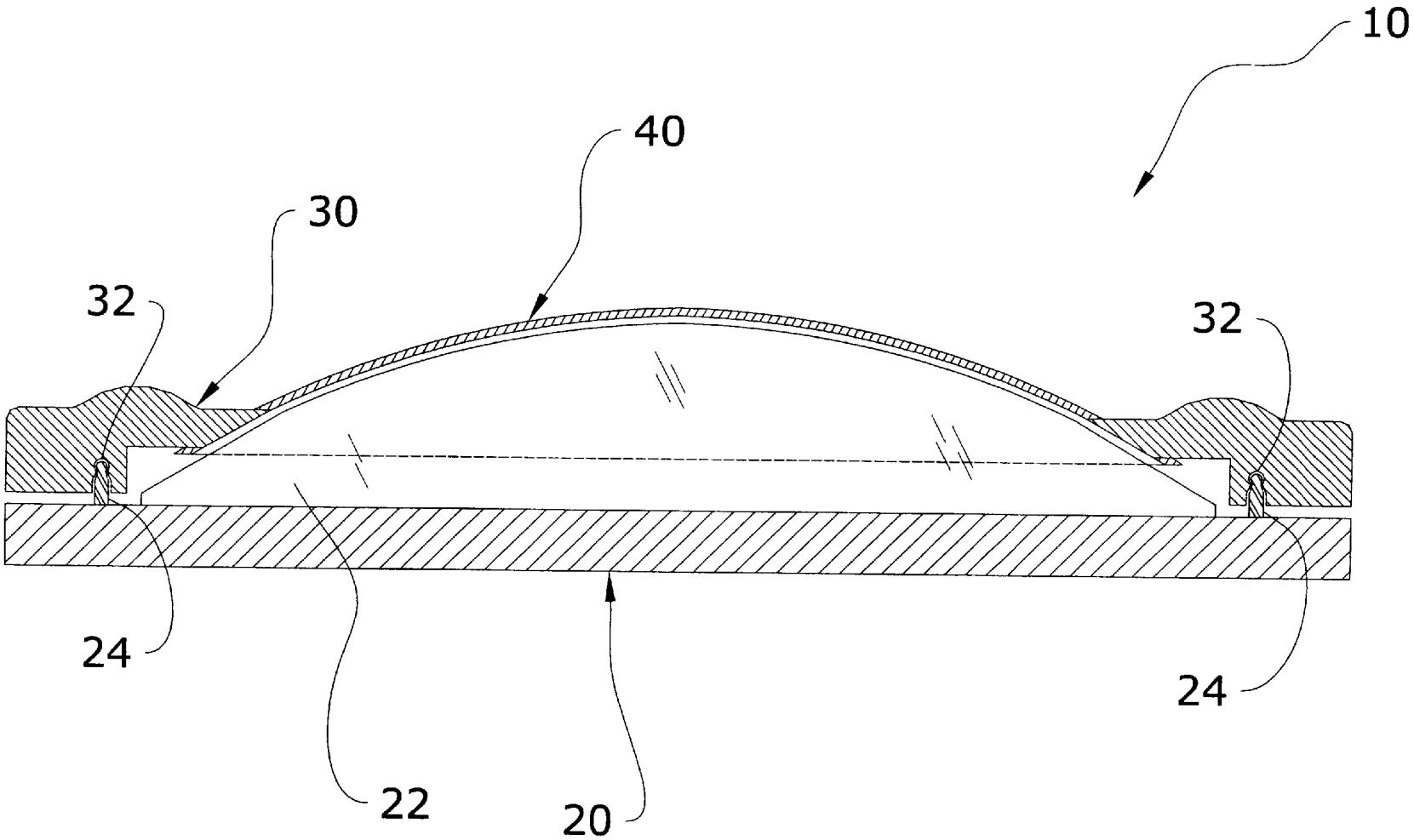
FIG. 4 is a cross sectional view taken along line 4—4 of FIG. 2.
Figure 5:
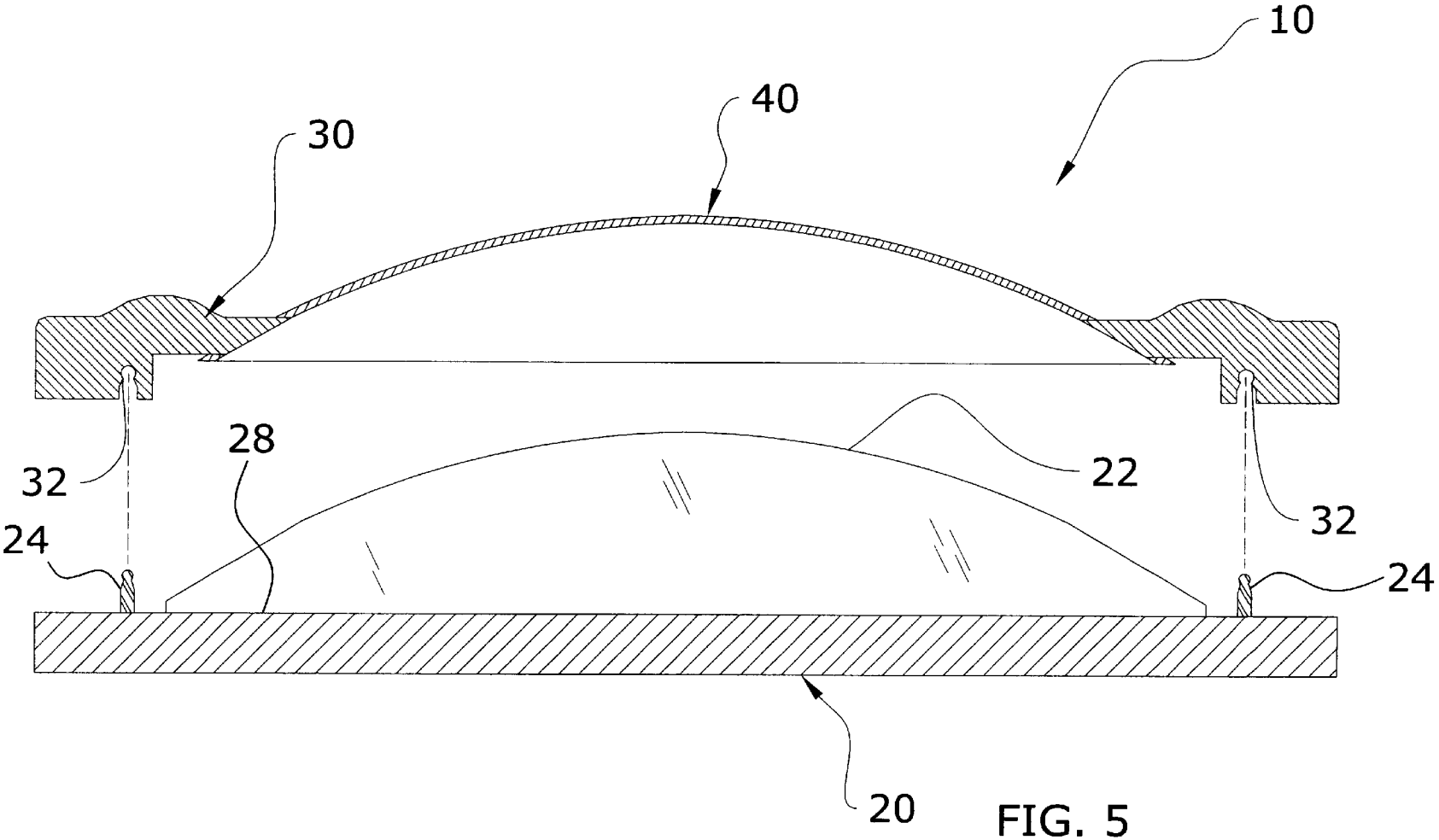
FIG. 5 is an exploded cross sectional view of FIG. 4.
Figure 6:
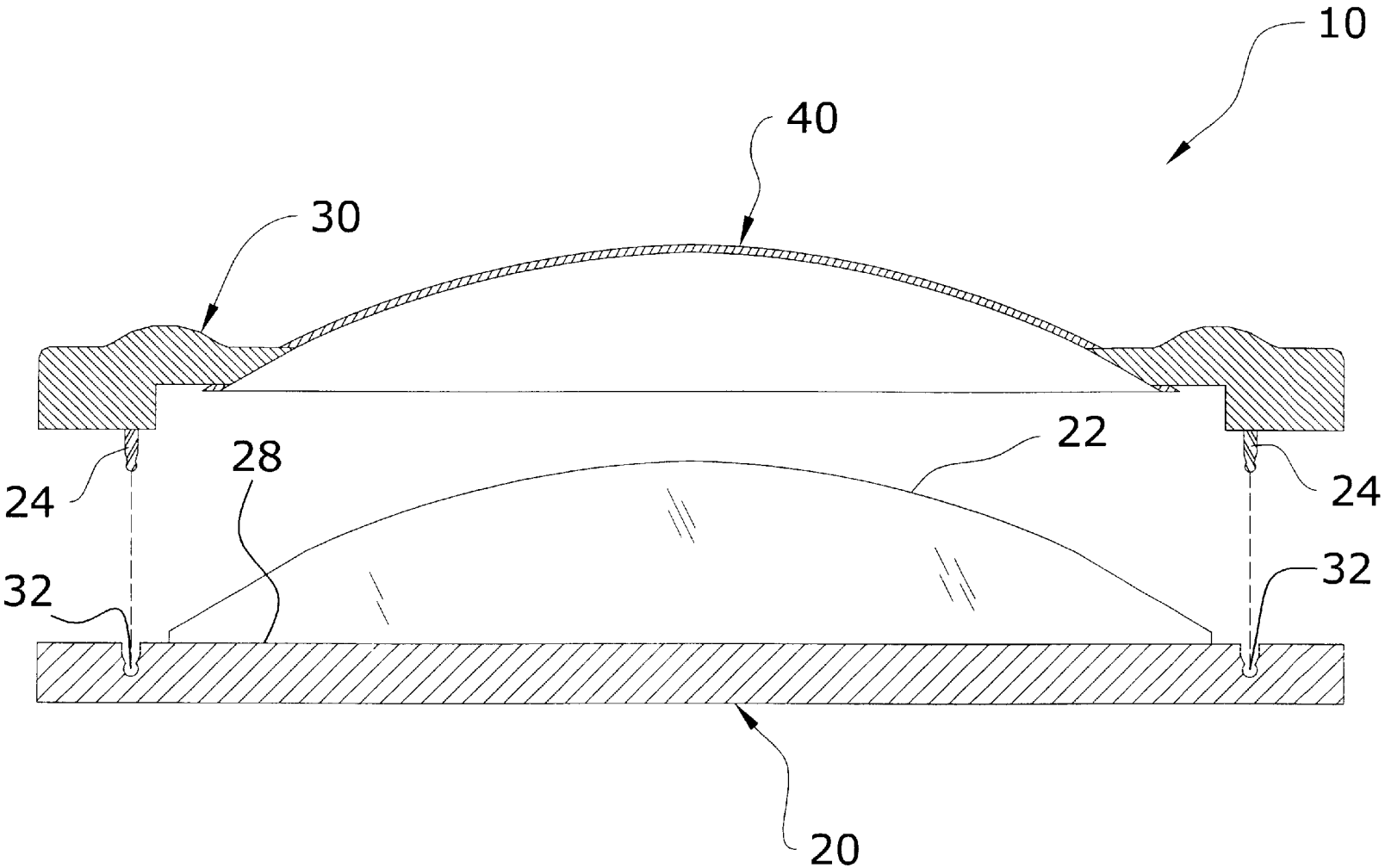
FIG. 6 is an exploded cross sectional view of an alternative embodiment illustrating the apertures within the rear plate and the securing members within the frame structure.

A support shelf 22 is preferably attached to a lower portion of the front surface 28 of the rear plate 20 as shown in FIGS. 1 and 2 of the drawings. The support shelf 22 has a flat upper surface and has an outer perimeter shape similar to the cross sectional shape of the enclosure 40 as best illustrated in FIGS. 4 and 5 of the drawings. The support shelf 22 may be comprised of various rigid support structures and materials.

D. Frame Structure

As shown in FIGS. 1 and 2 of the drawings, the frame structure 30 preferably has a shape and size similar to the rear plate 20. The frame structure 30 preferably has a center opening for allowing viewing of the display items 12 attached to the front surface 28 of the rear plate 20.

Figure 3:
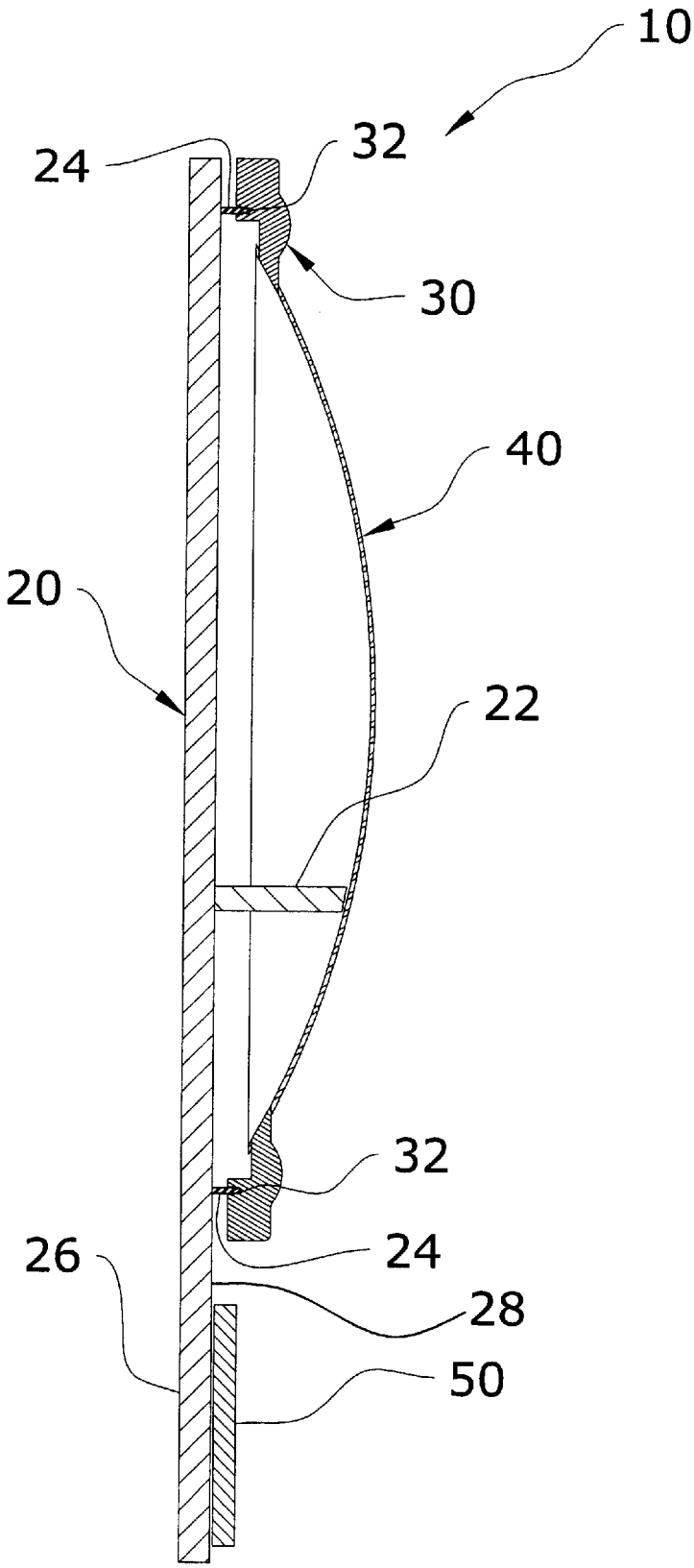
FIG. 3 is a cross sectional view taken along line 3—3 of FIG. 1.

The frame structure 30 is removably attachable to the rear plate 20 as illustrated in FIG. 5 of the drawings. The rear plate 20 preferably includes a plurality of securing members 24 that extend outwardly from a perimeter portion of the rear plate 20. The frame structure 30 also includes a plurality receiver apertures 32 that correspond to and catchably receive the securing members 24 as shown in FIGS. 3 through 5 of the drawings. The securing members 24 preferably each have a tapered neck portion forming a head portion that is catchably received within the receiver apertures 32 as best illustrated in FIG. 5 of the drawings. The receiver apertures 32 each have a narrow neck portion that catchably receives the head portion of the securing members 24 as best illustrated in FIG. 5 of the drawings. Alternatively, the securing members 24 may extend from the frame structure 30 and the receiver apertures 32 extend into the rear plate 20.

E. Enclosure

A transparent enclosure 40 is positioned within the frame structure 30 for allowing viewing of the magnetic display items 12 attached to the front surface 28 of the rear plate 20 as shown in FIGS. 1 through 5 of the drawings. As shown in FIGS. 1, 3, 4 and 5 of the drawings, the enclosure 40 is preferably comprised of a domed structure. The enclosure 40 has a shape similar to the shape of the rear plate 20 and the frame structure 30. The enclosure 40 may be transparent or semi-transparent. The enclosure 40 may be comprised of various materials such as but not limited to glass, plastic and the like.

F. Operation of Invention

The rear plate 20 is secured to a wall in a permanent manner. The user then is able to positioned one or more display items 12 upon the upper surface of the support shelf 22 as shown in FIG. 2 of the drawings. The user then may attach various magnetic display items 12 to the front surface 28 of the rear plate 20. The magnetic display items 12 may be integrally magnetized or attached to a magnet. The magnetic items are magnetically attracted to the metallic front surface 28 and/or a metal rear plate 20. The user then secures the frame structure 30 to the rear plate 20 for viewing by the resident and others. If a display item 12 is to be removed or added, the user simply removes the frame structure 30 and then makes the appropriate modification.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A display case system, comprising:

a rear plate having a front surface, wherein said rear plate is attachable to a wall structure;

wherein said front surface is comprised of a metallic layer for receiving magnetic display items;

a frame structure removably attachable to said rear plate; and a transparent enclosure positioned within said frame structure;

wherein said rear plate includes a plurality of securing members that extend outwardly from a perimeter portion of said rear plate, and wherein said frame structure includes a plurality receiver apertures that correspond to and catchably receive said securing members.

2. The display case system of claim 1, wherein said securing members each have a tapered neck portion forming a head portion that is catchably received within said receiver apertures.

3. The display case system of claim 2, wherein said receiver apertures have a narrow neck portion that catchably receives said head portion of said securing members.

4. The display case system of claim 1, wherein said enclosure is comprised of a domed structure.

5. The display case system of claim 1, including an extended portion extending from a lower portion of said rear plate and a sign structure attached to said lower portion.

6. The display case system of claim 1, including an identification structure attached to said front surface of said rear plate.

7. The display case system of claim 1, including a support shelf attached to a lower portion of said front surface of said rear plate.

8. A display case system, comprising:

a rear plate having a front surface, wherein said rear plate is attachable to a wall structure;

wherein said front surface is comprised of a metallic layer for receiving magnetic display items;

a frame structure removably attachable to said rear plate; and a transparent enclosure positioned within said frame structure;

wherein said frame structure includes a plurality of securing members that extend outwardly from a perimeter portion of said frame structure, and wherein said rear plate includes a plurality receiver apertures that correspond to and catchably receive said securing members.

9. The display case system of claim 8, wherein said securing members each have a tapered neck portion forming a head portion that is catchably received within said receiver apertures.

10. The display case system of claim 9, wherein said receiver apertures have a narrow neck portion that catchably receives said head portion of said securing members.

11. The display case system of claim 8, wherein said enclosure is comprised of a domed structure.

12. The display case system of claim 8, including an extended portion extending from a lower portion of said rear plate and a sign structure attached to said lower portion.

13. The display case system of claim 8, including an identification structure attached to said front surface of said rear plate.

14. The display case system of claim 8, including a support shelf attached to a lower portion of said front surface of said rear plate.

15. A display case system, comprising:

a rear plate having a front surface, wherein said rear plate is attachable to a wall structure;

wherein said front surface is comprised of a metallic layer for receiving magnetic display items;

a frame structure removably attachable to said rear plate;

a transparent enclosure positioned within said frame structure; and an identification structure attached to said front surface of said rear plate.

16. The display case system of claim 15, wherein said enclosure is comprised of a domed structure.

17. The display case system of claim 15, wherein said rear plate includes an extended portion extending from a lower portion of said rear plate, wherein said identification structure is attached to said extended portion.

18. The display case system of claim 15, including a support shelf attached to a lower portion of said front surface of said rear plate.

* * * * *